US007354218B1

(12) United States Patent
Dyke et al.

(10) Patent No.: US 7,354,218 B1
(45) Date of Patent: Apr. 8, 2008

(54) PORTABLE TRAFFIC BARRIER SYSTEM

(75) Inventors: Gerrit Dyke, Stockton, CA (US); Alvaro E. Morales Flores, Concord, CA (US)

(73) Assignee: Barrier Systems, Inc., Rio Vista, CA (US)

( * ) Notice: Subject to any disclaimer, the term of this patent is extended or adjusted under 35 U.S.C. 154(b) by 0 days.

(21) Appl. No.: 11/655,650

(22) Filed: Jan. 19, 2007

(51) Int. Cl.
*E01F 13/00* (2006.01)
*E01F 9/019* (2006.01)
*E01F 15/00* (2006.01)

(52) U.S. Cl. ..... 404/6; 180/287

(58) Field of Classification Search ..... 404/6; 180/287

See application file for complete search history.

(56) References Cited

U.S. PATENT DOCUMENTS 4,385,771 A * 5/1983 Eckels ..... 280/400
4,624,601 A * 11/1986 Quittner ..... 404/12
4,666,332 A 5/1987 Burgett
5,007,763 A 4/1991 Burgett
6,213,047 B1 * 4/2001 Means et al. ..... 116/28 R
6,231,065 B1 * 5/2001 Brown ..... 280/482
6,485,224 B1 11/2002 Dyke et al.
7,125,198 B2 * 10/2006 Schiefferly et al. ..... 404/6

* cited by examiner

*Primary Examiner*—Raymond W Addie
(74) *Attorney, Agent, or Firm*—Thomas R. Lampe

(57) ABSTRACT

A system for repositioning an elongated traffic barrier utilizes a tow vehicle connected to one end of the elongated traffic barrier to exert a pulling force on the elongated traffic barrier and a drag connected at the other end of the elongated traffic barrier to exert a drag force opposed to the pulling force exerted by the tow vehicle to resist wandering of the elongated traffic barrier during repositioning thereof.

18 Claims, 3 Drawing Sheets

PORTABLE TRAFFIC BARRIER SYSTEM

TECHNICAL FIELD

This invention relates to a portable traffic barrier system and more particularly to a method of repositioning an elongated traffic barrier and apparatus utilized in combination with an elongated traffic barrier for carrying out repositioning thereof.

BACKGROUND OF THE INVENTION

Vehicular traffic barriers or dividers are in widespread usage. Some of these systems incorporate a plurality of barrier modules disposed end-to-end. Such modules may, for example, be wholly or partially constructed of steel structural elements and/or wholly or partially constructed of concrete. Vehicular traffic barriers or dividers are often employed to separate lanes of traffic or to provide protection for ongoing construction work, and it is known to provide wheels projecting downwardly from the vehicular traffic barriers facilitating repositioning of the barriers.

U.S. Pat. No. 4,666,332, issued May 19, 1987, discloses a traffic barrier carrier or mover enabling connected traffic barrier sections to be repositioned. The carrier includes a supporting frame having two opposite end plates upon which adjacent ends of two generally aligned barrier sections are supported. The frame carriers incorporate a hydraulic cylinder which raises and lowers supporting wheels mounted on an axle under the frame. The wheels are moved between an upper position located above the lower extremities of the supporting frame with the barrier sections being supported on a surface, and a lower position below the lower extremities of the supporting frame with the barrier sections being raised above the surface. In the latter position of the wheels, the barrier sections can be moved from one position to another by a suitable towing vehicle which tows the traffic barrier sections and carriers in a train-like fashion, as needed. This provides an advantage over the commonly employed technique of employing a crane to lift and reposition the barrier sections.

U.S. Pat. No. 5,007,763, issued Apr. 16, 1991, discloses a traffic barrier section with a centrally-located built-in carrier, the carrier including a fluid-operated ram which is connected to an axle carrying wheels below the ram. When the wheels are in a retracted position, the barrier section rests on the ground, and when the wheels are extended the barrier section is fully supported on the wheels. In that latter position, a plurality of barrier sections which are pivotally connected can be moved from one construction site to another as needs change. Each axle and the wheels can be turned to a position other than perpendicular to the longitudinal extent of the barrier section so that some of the barrier sections can be moved transversely to place them in other than a straight line position.

Similar to the system of U.S. Pat. No. 4,666,332, a tow vehicle, such as a tractor, is hooked up to the leading end of the barrier train to pull it to a desired location.

The systems described above have certain deficiencies. When employing a truck, tractor or other tow vehicle the barrier will tend to "wander" due to the pivotal interconnection employed between the modular components or sections. Although it is suggested that steering structure may be associate with the sections, it is still difficult to maintain alignment between the modules and "wandering" of the string of modules while towed.

In addition, the rear ends of the prior art traffic barriers are essentially unprotected during the towing operation. An oncoming vehicle colliding with the exposed rear or tail end of the string can cause not only structural damage but also serious injury to personnel working adjacent to the barrier.

In addition, utilizing the towing approaches, exemplified by the arrangements disclosed in U.S. Pat. Nos. 4,666,332 and 5,007,763 tow vehicles are connected to the front of the string or train of towed modules by connector means centered with respect to the tow vehicle. That is, portions of the tow vehicles project outwardly laterally relative to the barrier. This not only exposes the tow vehicle and its operator to possible impact by passing vehicles, but can interfere with paving or other operations at road construction sites.

U.S. Pat. No. 6,485,224, issued Nov. 26, 2002, discloses a traffic barrier with gate and illustrates use of a pneumatic or hydraulic cylinder arrangement which is employed to move gate support wheels between a retracted position and an extended position wherein rollers engage the roadway or other support surface to facilitate movement of the gate.

DISCLOSURE OF INVENTION

The present invention relates to a system incorporating a method and apparatus which provides for safe towing of an elongated traffic barrier while exerting forces thereon which prevent substantial wandering of the string or train of barrier modules during the towing operation. Furthermore, protection is afforded at the rear end of the string to lessen damage caused from impact by approaching traffic. The string will tend to stay in alignment and individual modules prevented from substantial lateral deflection even in the case of impact by a vehicle approaching from the side. Furthermore, utilizing the apparatus and method of the present invention, the tow vehicle is offset relative to the elongated traffic barrier during pulling thereof so that protection is afforded to the tow vehicle and equipment and individuals engaged in paving or other construction activities adjacent to the traffic barrier. Such activities are not interfered with during repositioning of the elongated traffic barrier.

The structural combination of the present invention includes an elongated traffic barrier having spaced first and second ends, the elongated traffic barrier engaging and supported by a roadway or other support surface.

A tow vehicle is connected to the elongated traffic barrier at or closely adjacent to the first end and is operable to exert a pulling force on the elongated traffic barrier while the traffic barrier is in engagement with the support surface to reposition the elongated traffic barrier on the support surface.

A drag is connected to the elongated traffic barrier at or closely adjacent to the second end and is operable to exert a drag force on the elongated traffic barrier opposed to and of lessor magnitude than the pulling force exerted on the elongated traffic barrier by the tow vehicle. The opposed forces resist wandering of the elongated traffic barrier during repositioning thereof.

The elongated traffic barrier has an elongated axis extending between the first and second ends, the tow vehicle being offset relative to the elongated axis.

The method of the present invention is for repositioning an elongated traffic barrier having spaced first and second ends on a roadway or other support surface.

The method includes the step of connecting a tow vehicle to the elongated barrier at or closely adjacent to the first end.

A drag is connected to the elongated traffic barrier at or closely adjacent to the second end.

The tow vehicle is employed after connection thereof to the elongated traffic barrier to pull the elongated traffic barrier while the traffic barrier is in engagement with the support surface to reposition the elongated traffic barrier on the support surface.

While the tow vehicle is pulling the elongated traffic barrier, the drag is utilized to exert a drag force on the elongated traffic barrier opposed to the pulling force exerted on the elongated traffic barrier by the tow vehicle.

The opposed forces exerted on the elongated traffic barrier by the tow vehicle and the drag are utilized to resist bending of the elongated traffic barrier during repositioning thereof.

The method also includes the step of maintaining the tow vehicle offset relative to the elongated axis of the traffic barrier during pulling of the elongated traffic barrier by the tow vehicle.

Other features, advantages and objects of the present invention will become apparent with reference to the following description and accompanying drawings.

BEST MODE FOR CARRYING OUT THE INVENTION

Referring now to FIGS. 1-3, 5 and 6, an elongated traffic barrier 10 is shown. The elongated traffic barrier 10 is illustrative of the type of portable traffic barrier to which the teachings of the present invention are applicable. In particular, the barrier 10 may be of the type disclosed in co-pending U.S. patent application Ser. No. 11/655,302, filed Jan. 19, 2007. In this embodiment, the barrier 10 and the embodiment illustrated is constructed of structural elements of steel. It will be appreciated, however, that the principles of the present invention are applicable to other types of portable roadway barriers comprised of barrier modules articulatively connected at their adjacent ends to provide a barrier string. For example, the principles of the present invention could be utilized when traffic barrier modules are primarily formed of concrete.

Figures 1, 2, 3:
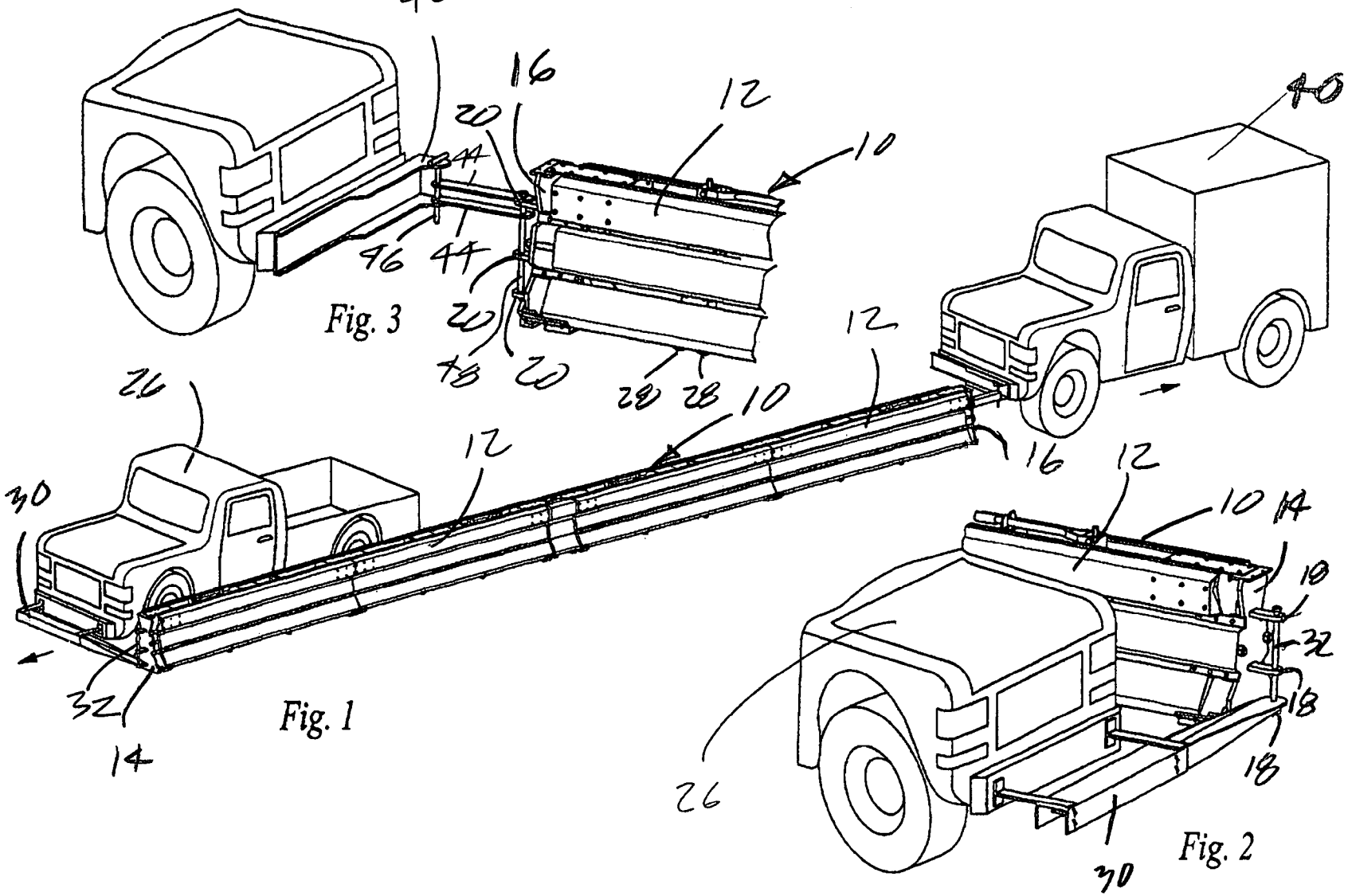
FIG. 1 is a perspective view illustrating a tow vehicle connected to an elongated traffic barrier at the front end of the traffic barrier and a drag vehicle attached to the rear end of the elongated traffic barrier exerting a force on the barrier opposed to that exerted thereon by the tow vehicle during towing.
FIG. 2 is an enlarged, frontal perspective view illustrating the front portion of the tow vehicle and connector structure interconnecting the tow vehicle to the front end of the elongated traffic barrier.
FIG. 3 is a perspective view illustrating a front portion of the drag vehicle and its interconnection with the rear end of the elongated traffic barrier.
Figures 4A, 4B, 4C:
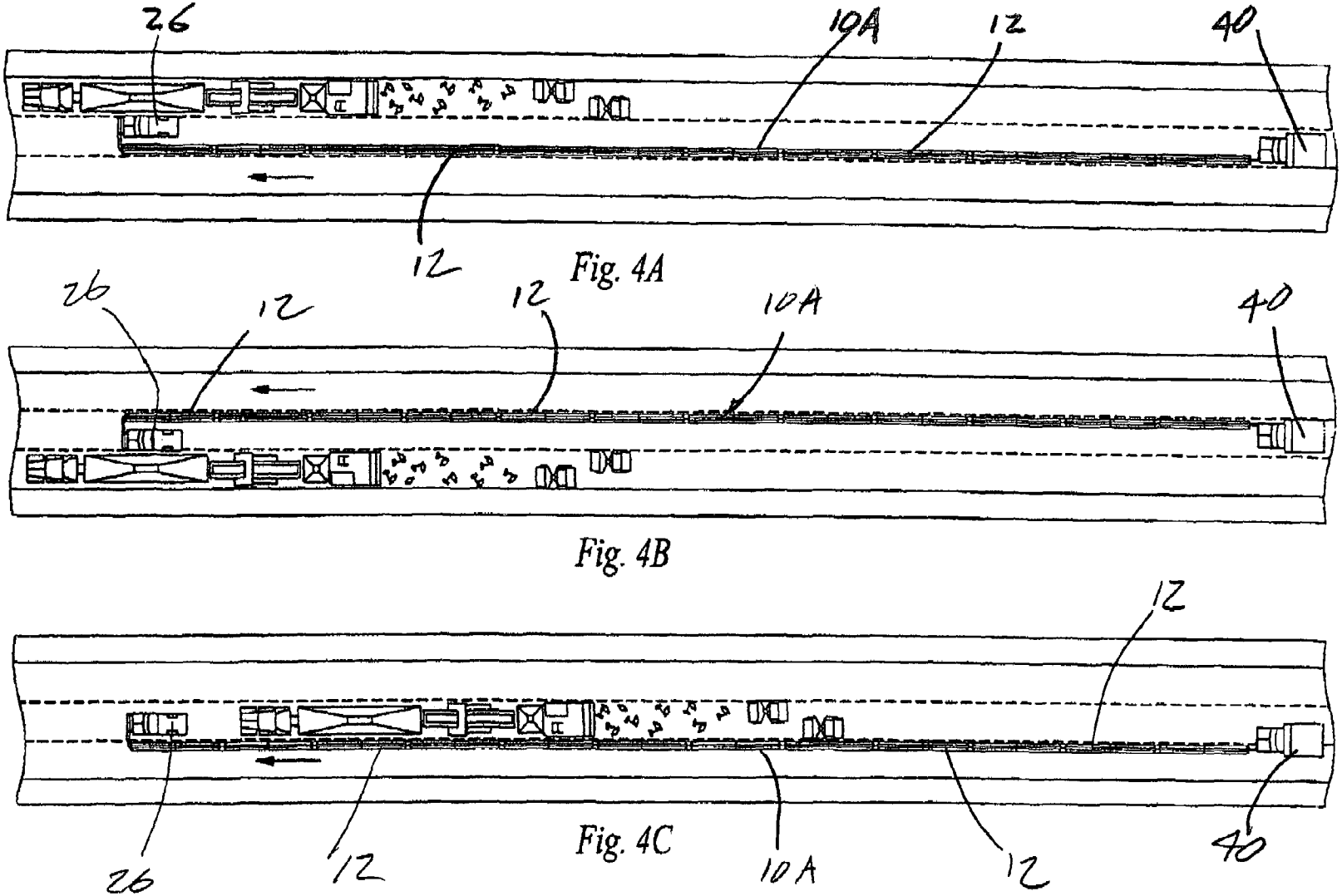
FIGS. 4A-4C are plan, birds eye views of typical paving construction sites and illustrating how the structural combination and method of the present invention may be practiced when repositioning an elongated traffic barrier at the sites.
Figures 5, 6:
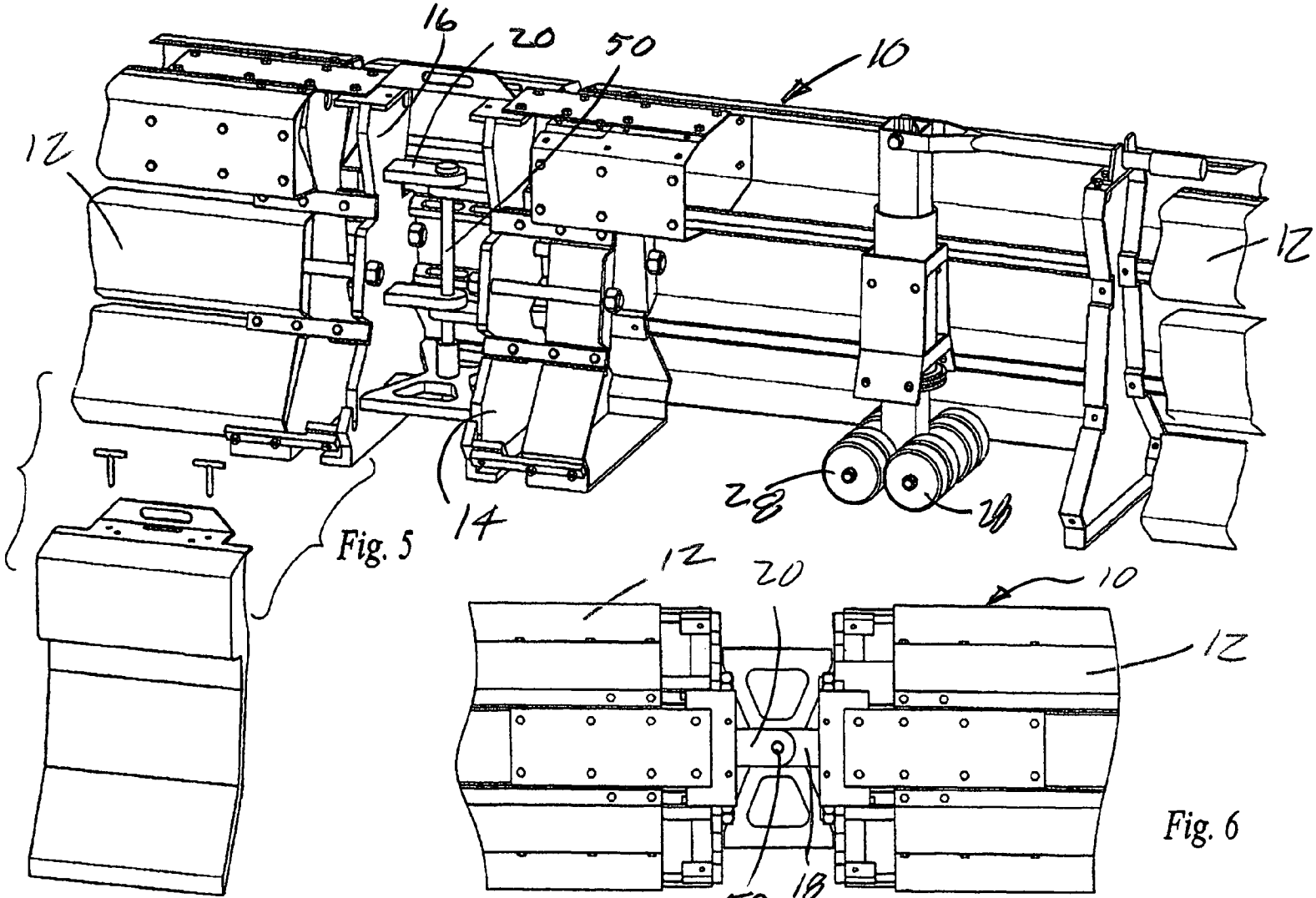
FIG. 5 is a perspective, exploded view of two interconnected barrier module ends, portions of one such module being broken away to illustrate the internal structure thereof, and a cover plate removed to show structural details of the connector structure between adjacent barrier module ends.
FIG. 6 is a top, plan view of the barrier module ends shown in FIG. 5 with both cover plates normally associated therewith and extending therebetween removed to illustrate structural details of the connector structure and a pivot restrictor element.

The traffic barrier modules of barrier 10 are identified by reference numeral 12. FIG. 1 illustrates two such modules; however, the invention is applicable to elongated traffic barriers having more modules. FIGS. 4A-4C, for example illustrate an elongated traffic barrier 10A comprised of twelve interconnected modules 12.

The elongated traffic barrier 10 has a first or front end in the form of a plate 14 and a second or rear end in the form of a plate 16. Projecting outwardly from the front end plate 14 and rigidly attached thereto are brackets 18 defining aligned apertures. Likewise, brackets 20 having aligned apertures project outwardly from rear plate 16.

A tow vehicle 26, which may suitably be a truck for example, as shown, is employed to exert pulling forces on the elongated traffic barrier to pull the elongated traffic barrier while the traffic barrier is in engagement with the roadway or other support surface. The traffic barrier modules incorporate wheels 28 which are alternatively raised or lowered by a hydraulic or pneumatic jack as taught generally in the prior art, including U.S. Pat. No. 5,007,763 and U.S. Pat. No. 6,485,224, for example. It will be appreciated that the wheels are lowered and extend downwardly into engagement with the roadway or ground during the towing process and are retracted upwardly after the elongated traffic barrier has been positioned where desired.

Tow vehicle 26 is offset relative to the elongated axis of the elongated traffic barrier and is disposed alongside the elongated traffic barrier as shown in the drawings. Connection between the front end of the elongated traffic barrier and the tow truck 26 is accomplished by a tow bar 30 formed of steel or the like which is attached to the front of the tow vehicle and projects laterally outwardly from the tow vehicle to a location in front of plate 14. An elongated pivot pin 32 passes through an aperture formed at the distal end of the tow bar and the aligned apertures of brackets 18.

Disposed at the second or rear end 16 of the elongated traffic barrier is a drag vehicle 40, which in the illustrated arrangement is in the form of a truck which may, for example, have a rear warning display (not shown) at the back thereof.

The purpose of the tow vehicle is to exert a drag force on the elongated traffic barrier opposed to and of lesser magnitude than the pulling force exerted on the elongated traffic barrier by the tow vehicle. This resists bending and wandering of the elongated traffic barrier during repositioning thereof. Furthermore, the drag vehicle affords protection from impact by vehicular traffic from the rear. In addition, by maintaining the elongated traffic barrier in a somewhat taut condition, sideways deflection of the traffic barrier due to side impact is also lessened. A portion of the drag vehicle 40 is disposed directly behind the elongated traffic barrier with the remainder thereof located behind the tow vehicle 26. This offset feature enables paving or other construction activities on one side of the barrier to be carried out unimpeded while still affording protection for the paving or other equipment and personnel employed at the site adjacent to the elongated barrier.

The drag vehicle is releasably connected to the elongated traffic barrier by drag connector structure including a drag bracket 42 attached to the drag vehicle located behind rear end 16, bracket structure in the form of rear brackets 20 extending from rear end plate 16 and linkage releasably interconnecting the drag bracket 42 to brackets 20. In the arrangement illustrated, this linkage includes connector bars 44 of a channel member extending between the drag bracket 42 and brackets 20 and connected at the ends thereof by link or connector pins 46, 48.

In the arrangement illustrated, the articulative connection is a pivotal connection between adjacent modules provided by a pivot pin 50 disposed between opposed end plates 14, 16 thereof. The pivot pin 50 (see FIGS. 5 and 6) is located in aligned holes of brackets 18, 20 projecting from the plates. A restrictor element 52 is pivotally mounted on pivot pin 50 and extends outwardly from opposed sides thereof. The restrictor element is engageable with the opposed end plates to limit pivotal or other articulative movement between adjacent modules, thus providing another approach to preventing deflection of the elongated traffic barrier.

The invention claimed is:

1. In combination:

an elongated traffic barrier having spaced first and second traffic barrier ends, said elongated traffic barrier including a plurality of traffic barrier modules, each module of said plurality of traffic barrier modules having module ends and interconnected at least one module end thereof to a module end of a module adjacent thereto, and each module including wheels or other rotatable members for engaging a roadway or other support surface to support said elongated traffic barrier on said roadway or other support surface;

a tow vehicle connected to said elongated traffic barrier at or closely adjacent to said first traffic barrier end operable to exert a pulling force on said elongated traffic barrier to pull said elongated traffic barrier while said elongated traffic barrier is in engagement with the support surface and supported by said rotatable members to reposition said elongated traffic barrier on said support surface; and a drag connected to said elongated traffic barrier behind said first traffic barrier end operable to exert a drag force on said elongated traffic barrier opposed to the pulling force exerted on said elongated traffic barrier by said tow vehicle to maintain the elongated traffic barrier in a taut condition to resist wandering of the modules of said elongated traffic barrier during repositioning thereof.

2. The combination according to claim 1 wherein said elongated traffic barrier has an elongated axis, said tow vehicle being offset relative to said elongated axis.

3. The combination according to claim 2 wherein said drag comprises a drag vehicle offset relative to said elongated traffic barrier and disposed behind said tow vehicle to provide protection from vehicles approaching from the rear of the drag vehicle, said combination including tow connector structure releasably connecting said tow vehicle to said elongated traffic barrier and drag connector structure releasably connecting said drag vehicle to said elongated traffic barrier.

4. The combination according to claim 3 wherein said tow connector structure includes a tow bar attached to said tow vehicle and projecting laterally outwardly from said tow vehicle to a location at said first traffic barrier end, first end bracket structure attached to said first traffic barrier end, and linkage releasably interconnecting said tow bar to said first end bracket structure.

5. The combination according to claim 4 wherein said tow vehicle is disposed alongside said elongated traffic barrier.

6. The combination according to claim 3 wherein said drag connector structure includes a drag bracket attached to said drag vehicle and link structure releasably interconnecting said drag bracket to said elongated traffic barrier.

7. The combination according to claim 6 wherein a portion of said drag vehicle is disposed behind said elongated traffic barrier.

8. The combination according to claim 1 including restrictor structure disposed between adjacent traffic barrier modules for limiting articulative movement therebetween.

9. A method of repositioning an elongated traffic barrier having spaced first and second traffic barrier ends, said elongated traffic barrier including a plurality of traffic barrier modules, each module of said plurality of traffic barrier modules having module ends and interconnected at least one module end thereof to a module end of a module adjacent thereto, and each module including module wheels or other rotatable members for engaging a roadway or other support surface, the method including the steps of:

supporting said elongated traffic barrier on a roadway or other support surface by said rotatable members;

connecting a tow vehicle to said elongated barrier at or closely adjacent to said first traffic barrier end;

connecting a drag to the elongated traffic barrier behind said first traffic barrier end;

employing said tow vehicle after connection thereof to said elongated traffic barrier to pull said elongated traffic barrier while said elongated traffic barrier is supported by said rotatable members on said support surface to reposition said elongated traffic barrier on said support surface;

while said tow vehicle is pulling said elongated traffic barrier supported by said rotatable members, utilizing said drag to exert a drag force on said elongated traffic barrier opposed to the pulling force exerted on said elongated traffic barrier by said tow vehicle; and utilizing the opposed forces exerted on said elongated traffic barrier by said tow vehicle and said drag to maintain the elongated traffic barrier in a taut condition to resist wandering of the modules of said elongated traffic barrier during repositioning thereof.

10. The method according to claim 9 wherein said elongated traffic barrier has an elongated axis, said method including the step of maintaining said tow vehicle offset from said elongated axis during pulling of said elongated traffic barrier by said tow vehicle.

11. The method according to claim 10 wherein said tow vehicle is maintained alongside said elongated traffic barrier during pulling of said elongated traffic barrier by said tow vehicle.

12. The method according to claim 9 wherein said drag is a motor driven drag vehicle.

13. The method according to claim 12 including the step of maintaining said drag vehicle offset relative to said elongated traffic barrier and disposed behind said tow vehicle to provide protection from vehicles approaching from the rear of said drag vehicle.

14. The method according to claim 12 wherein said tow vehicle and said drag vehicle are both releasably connected to said elongated traffic barrier.

15. The method according to claim 9 wherein a tow bar projects laterally outwardly from said tow vehicle toward said first traffic barrier end, said tow bar being employed to pull said elongated traffic barrier.

16. The method according to claim 13 including disposing a portion of said drag vehicle behind said elongated traffic barrier.

17. The method according to claim 9 including the step of positioning restrictor structure between adjacent traffic barrier modules and employing said restrictor structure between adjacent barrier modules to limit articulation movement therebetween.

18. The method according to claim 9 including utilizing said drag to apply a drag force of lesser magnitude than said pulling force during repositioning of said elongated traffic barrier on said support surface.

* * * * *